US005224800A

United States Patent [19]

Mogridge et al.

[11] Patent Number: 5,224,800

[45] Date of Patent: Jul. 6, 1993

[54] PROTECTIVE SYSTEM AGAINST ICEBERGS OR FLOATING OBJECTS

[75] Inventors: Geoffrey R. Mogridge, Ottawa; Edgar R. Funke, Gloucester, both of Canada

[73] Assignee: National Research Council of Canada, Ottawa, Canada

[21] Appl. No.: 803,643

[22] Filed: Nov. 29, 1991

[30] Foreign Application Priority Data

Dec. 12, 1990 [CA] Canada ..... 2032096

[51] Int. Cl.[5] ..... E02D 31/00

[52] U.S. Cl. ..... 405/211; 405/195.1; 405/61; 405/224

[58] Field of Search ..... 405/211, 217, 61, 195.1, 405/204, 224; 114/264, 265, 293

[56] References Cited

U.S. PATENT DOCUMENTS

| | | | |
|---|---|---|---|
| 218,962 | 8/1879 | Hansler | 405/61 |
| 3,436,920 | 4/1969 | Blenkarn et al. | 405/61 |
| 3,845,633 | 11/1974 | Hammond | 405/211 |
| 4,103,504 | 8/1978 | Ehrlich | 405/211 |
| 4,215,952 | 8/1980 | Baardsen | 405/211 |
| 4,295,758 | 10/1981 | Yashima | 405/217 X |
| 4,470,724 | 9/1984 | Pollack | 405/211 |
| 4,547,093 | 10/1985 | Statham | 405/217 X |
| 4,662,790 | 5/1987 | Loire | 405/212 |
| 4,755,157 | 7/1988 | Coleman | 405/211 X |
| 4,826,353 | 5/1989 | Statham | 405/217 X |

FOREIGN PATENT DOCUMENTS

| | | |
|---|---|---|
| 1222383 | 6/1987 | Canada . |
| 1232768 | 2/1988 | Canada . |

*Primary Examiner*—Dennis L. Taylor
*Attorney, Agent, or Firm*—Ronald G. Bitner

[57] ABSTRACT

The system utilizes one or more buoyant members which are attached to a mooring line or lines anchored to the sea bed. The mooring line has a length limited to provide travel constraints on the travel path of the buoyant member, whereby upon collision of floating object with the buoyant member or mooring line, the resulting lateral displacement will effect downward travel of the buoyant member and absorb kinetic energy of a floating object approaching the offshore area to be protected. In one embodiment a number of buoyant members are connected to one another to partially or completely encircle the area to be protected. In another embodiment the buoyant members are arranged alongside a navigable route to prevent vessels from running aground or onto shoals.

7 Claims, 2 Drawing Sheets

PROTECTIVE SYSTEM AGAINST ICEBERGS OR FLOATING OBJECTS

FIELD OF THE INVENTION

This invention relates to a system for protecting an offshore area from floating objects, such as icebergs.

BACKGROUND OF THE INVENTION

Certain offshore regions that have large petroleum resources, such as the east coast of Canada, also suffer from the threat of drifting icebergs. The movements of these icebergs due to currents and wind are erratic and difficult to predict, and their size varies considerably. Based on records kept over recent years, it has been predicted that an iceberg with a mass of $5\times10^6$ tonnes with a velocity of 1 m/s can be expected. The kinetic energy of such an iceberg presents a difficult problem in offshore engineering.

Although the petroleum industry has acquired considerable expertise in building structures to withstand the environmental loading due to the ocean waves, wind and current, there has not been, to date, an entirely satisfactory method of dealing with drifting icebergs.

The damage which may be caused by an iceberg is not only the potential destruction of an oil exploration and production platform, but also damage to all the ocean bed mounted facilities such as well heads, pipes, manifolds and tanker mooring facilities. In addition to the loss of capital equipment and disruption to exploration and production, there may also be environmental damage.

Proposals to date for development of petroleum resources in iceberg infested waters include one of the following: One approach is to monitor iceberg activity so that smaller icebergs can be towed away, or the production vessel itself can be moved. Another approach is to install a relatively massive fixed production platform that can withstand the iceberg impact forces. However with either of these approaches, the icebergs remain a threat to the tanker loading facilities and subsea installations such as production manifolds and flowlines, as well as the platform itself.

Several approaches have been proposed to provide iceberg impact protection for a single platform. One approach is disclosed in U.S. Pat. No. 4,215,952 which proposes a compliant surface attached to the below water surface of a platform. Canadian Patent No. 1,222,383 describes a system of chains attached from the top of a platform to either the bottom of the platform or to the sea bed. Some of these tension lines are described as attached to energy dissipating arrestors, which are placed on the deck of the platform. An impacting iceberg is claimed to collide with the tension lines first, thereby dissipating some or all of its kinetic energy. Canadian Patent No. 1,232,768 discloses a system consisting of a large diameter, axially stiff, buoyant annular structure which surrounds an offshore structure to be protected. The "lightly" buoyant ring is attached to the base of the platform by means of mooring lines which are "downwardly inclining towards the platform". Heavy ballast weights are attached to the ring which rest on the sea bed. During the impact of an iceberg against the annular structure, the ring will drag the ballast weights across the sea bed and may cause them to be lifted. This is purported to cause energy dissipation. The restraining forces due to the collision are taken up by the base of the platform. Another system, which is similar but does not claim protection against icebergs, is disclosed in U.S. Pat. No. 4,470,724. This patent describes a "tying system for mooring lines" of an offshore transfer terminal to avoid collision between a tanker and the floating, moored offshore terminal.

It would be desirable to provide iceberg protection for a limited area rather than to construct a specially designed iceberg resistant platform. Such special purpose platforms are significantly more expensive and they cannot provide protection to all of the submarine installations which typically surround the operation site. Furthermore, there are many conventional tankers and platforms available which could be adapted to production and placed into uninterrupted operation if suitable means can be found to protect them from the hazards of iceberg collision.

It would also be desirable to provide a system capable of restricting vessels, for example oil tankers, to navigable routes.

SUMMARY OF THE INVENTION

It is an object of the present invention to provide a system for protecting an offshore area from floating objects, such as icebergs.

It has been found that an offshore area can be protected from massive floating objects by the use of a system that absorbs the kinetic energy of the object by submerging a buoyant member or members attached to mooring lines anchored to the sea bed in a particular arrangement as described herein.

The system of the present invention comprises; at least one buoyant member providing a predetermined upward buoyant force upon submergence; a mooring line attached to each buoyant member and anchored to the sea bed at a position spaced away from the area to be protected, said mooring line having a length sufficient to allow contact of the floating object with the buoyant member or mooring line, and having a length limited to provide travel constraints on the travel path of the buoyant member such that lateral displacement thereof effects downward travel of the buoyant member, whereby upon collision of a floating object with the buoyant member or mooring line the resulting laterally displacement thereof will effect downward travel and absorb kinetic energy of the floating object approaching the offshore area to be protected; and wherein the values of the buoyancy force upon submergence and available submergence distance of the buoyant member upon collision with the floating object are selected such that the product thereof equals a value corresponding to a selected portion of the kinetic energy of a predetermined floating object against which protection is desired.

DESCRIPTION OF THE PREFERRED EMBODIMENTS

Figure 1:
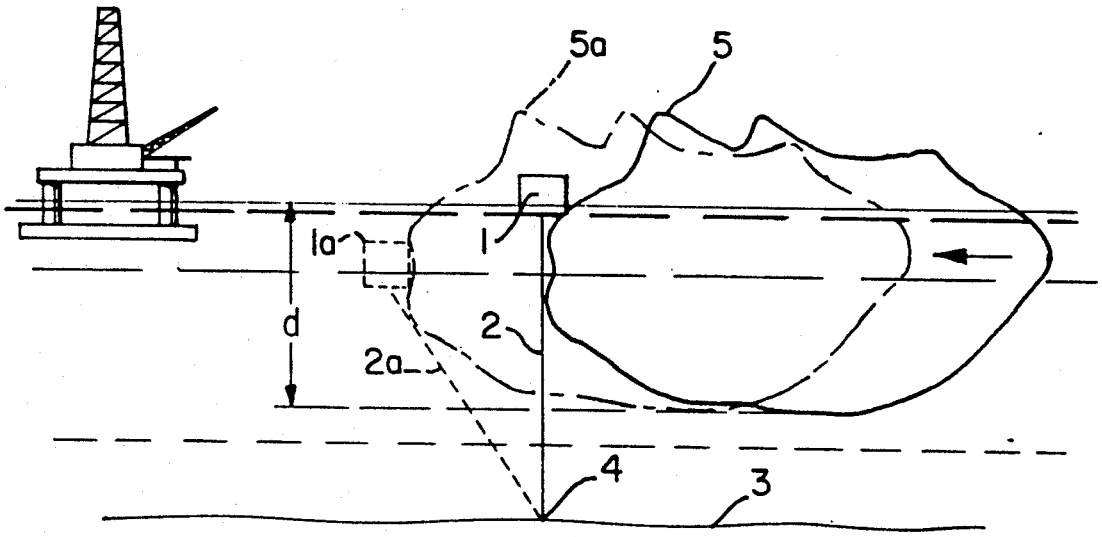
FIG. 1 is schematic elevation of one embodiment of the present invention showing the arrangement prior to and after contact by an iceberg with the buoyant member.

Referring to FIG. 1, the present invention comprises a buoyant member 1 spaced from the area to be protected by mooring line 2 moored to the sea bed 3 at a point 4 spaced from the area to be protected. The length of the mooring line 2 must be sufficient to allow either the buoyant member 1 or the mooring line 2 to be contacted by the floating object 5. In FIG. 1 the length of the line 2 is shown sufficiently long to allow the buoyant member to reach the surface.

The length of the line 2 must be limited to provide travel constraints on the travel path of the buoyant member 1 such that lateral displacement thereof effects downward travel of the buoyant member 1. Upon collision the resulting lateral displacement of the buoyant member will effect downward travel and absorb kinetic energy.

The amount of energy absorbed is related to the buoyant force of the buoyant member 1 upon submergence and the available submergence distance upon collision of the floating object. The available submergence distance is the vertical distance from the initial position of the buoyant member to the lower surface of the floating object.

The buoyant force of the buoyant member and the available submergence distance will be selected such that the product thereof equals a value corresponding to a selected portion of the kinetic energy of a floating object of predetermined kinetic energy against which protection is desired. As will be described, the selected portion will depend on such factors as how many buoyant members will be utilized, how they are interconnected, and what other means of energy absorption are utilized.

The operation of the invention can be best seen with reference to FIG. 1. As the floating object 5 makes contact with the buoyant member or mooring line 2 it displaces the buoyant member laterally in the direction of travel. As the buoyant member is displaced laterally it will necessarily be drawn downward along an arc due to its attachment with the mooring line 2 which defines a radius. As the buoyant member is drawn downward through the water it absorbs energy by an amount equal to the force times the distance that the buoyant member travels submerged. With reference to FIG. 1, the maximum energy absorbed, due to submergence, is the product of the available submergence distance d of the buoyant member 1 with respect to the floating object 5 times the buoyant force. The buoyancy force of a buoyant member can readily be calculated from values of displaced volume and mass or specific gravity. It should be noted that the weight of the mooring lines must be considered in determining the net or effective buoyancy force.

Energy is also absorbed due to elastic stretching of the mooring line upon impact with the buoyant member. The elastic properties of most commonly used mooring lines whether cable or chain will inherently provide a significant amount of energy absorption for the lengths that would be used. The higher the compliancy, the smaller will be the loading of the mooring lines, but at the expense of a longer horizontal deceleration distance for the floating object.

Other mechanisms contributing to the absorbtion of energy are hydrodynamic drag of the buoyant member and the mooring line.

Figure 2:
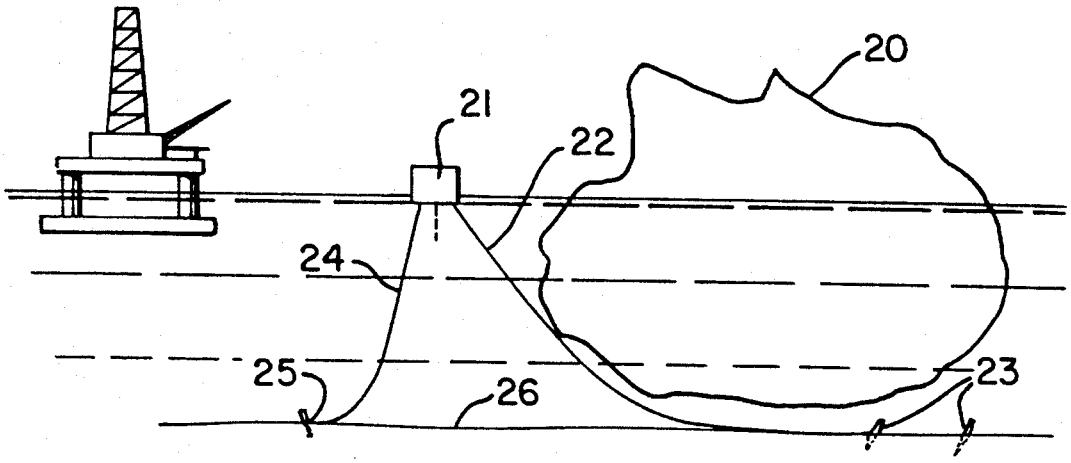
FIG. 2 is a schematic illustration of another embodiment of the invention showing an alternate arrangement for mooring the buoyant members.

FIG. 2 shows an alternate arrangement for mooring the buoyant member 21 using a catenary mooring system. A first mooring line 22 is shown anchored at 23 and a second line 24 is anchored at 25 on the sea bed 26. Two or more such mooring lines restrict the horizontal travel distance of the buoyant member. This arrangement will also store energy as potential energy in straightening the catenary profile of the line upon collision by the floating object 20.

Figure 3:
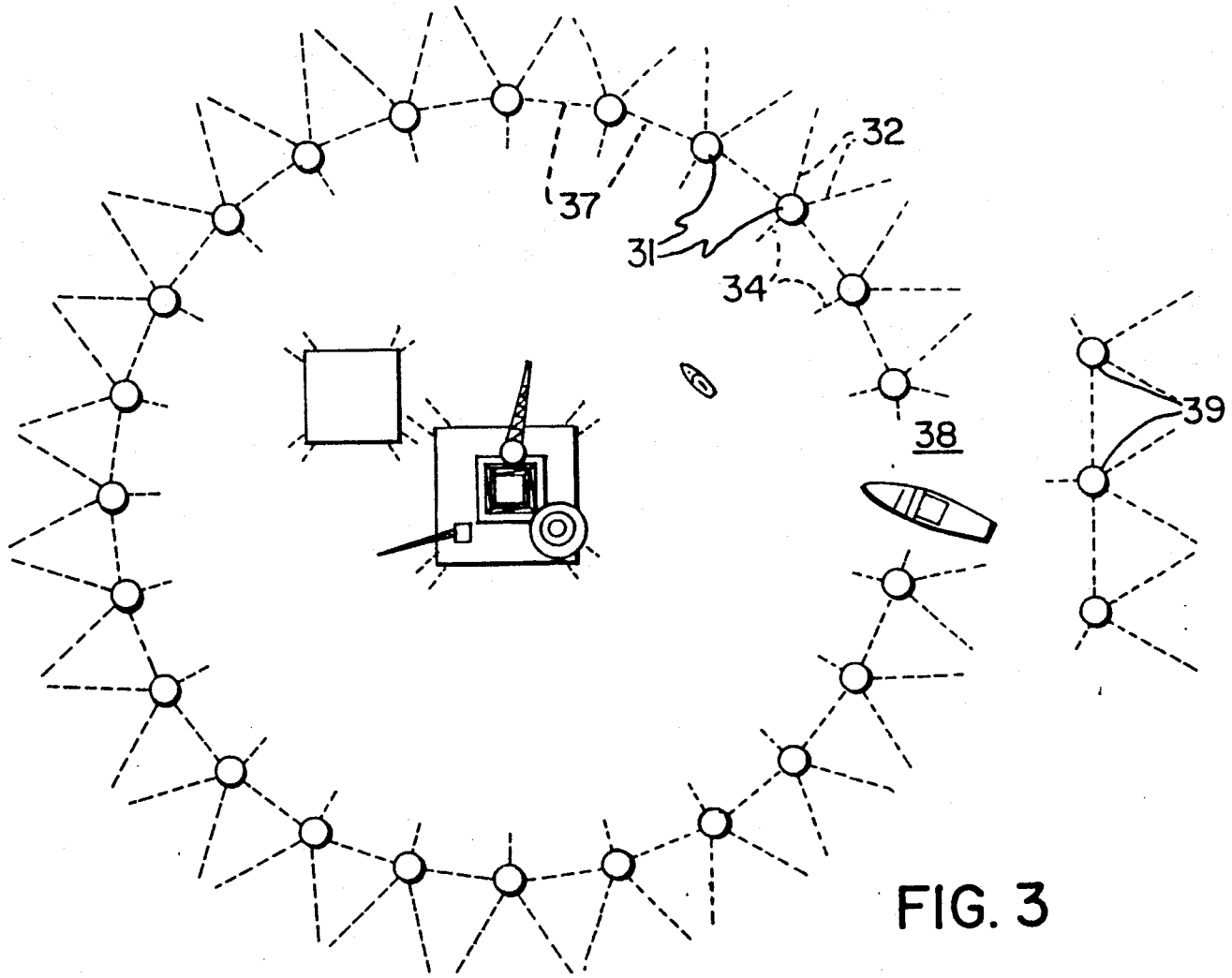
FIG. 3 is a schematic top view showing a plurality of buoyant members arranged to protect an offshore area.

FIG. 3 shows a plurality of buoyant members 31 moored by mooring lines as in FIG. 2 and interconnected by interconnecting lines 37. As shown, the buoyant members are arranged to partially surround the offshore area to be The interconnecting lines 37 can be utilized to prevent ice masses or floating objects, smaller than the buoyant member spacing, from passing between adjacent buoyant members 31. For this purpose the interconnecting lines 37 will preferably comprise a network of chains or cables between adjacent buoyant members 31.

Each buoyant member 31 can be designed to absorb only a selected portion of the total kinetic energy of the floating object, since adjacent buoyant members will also be submerged and contribute to energy absorption. The spacing and buoyancy force of individual buoyant members in such an interconnected arrangement will be selected with consideration of factors such as the size of the smallest object to be repulsed, the overall effectiveness in stopping or deflecting extremely large objects, the desired reliability through redundancy, and allowance for the possibility of interactions between adjacent buoyant members in waves and currents. The characteristics of the system will also be effected by the elasticity of the interconnecting lines 37.

It will be understood that the buoyant member can be constructed of various materials and geometries, providing that it provides the required buoyant force. The size and shape can be designed to provide the desired compliant and hydrodynamic behaviour. For example, a small buoy will provide a more compliant system than a large buoy. Also, the buoyant members can be arranged in various ways depending on the nature of the area to be protected and the nature and direction of travel expected from the floating objects from which the area is to be protected.

One possible use for the present invention is to restrict vessels to navigable channels or routes. For example, a plurality of buoyant members may be arranged alongside a frequently traveled route to safeguard against ships, particularly oil tankers, from running aground or onto shoals.

It should be noted that in operation the floating object may make contact with either the buoyant member or the mooring line, depending on the geometry of the floating object or the arrangement of the mooring line or lines. For example, in the case of icebergs, most iceberg profiles would make contact with a line or lines first. On the other hand, for use in restricting vessels in a navigable channel, it may be undesirable for the vessel to make contact with the line.

It should also be noted that protection against a floating object may be achieved by either stopping or deflecting it, or both. For example, a circular arrangement, as shown in FIG. 3, is more likely to result in deflection. If an object is to be stopped, then a linear arrangement may be more suitable.

The use of the term "offshore" as used herein is intended to include the nearshore or coastal zone and inland waters.

EXAMPLE

A research program was conducted to confirm the viability of the proposed concept. The study involved the development of a numerical model to simulate the interaction of an iceberg and a moored-buoy system. This was validated through physical model tests at a model scale of 1:100.

The numerical simulation was applied to a specimen system arranged as shown in FIG. 2 with two buoys having a diameter of 10 m and height of 4 m, and moored by two chains each. Such a system is effective in stopping a 5 million tonne iceberg drifting with a velocity of 1 m/s.

What is claimed is:

1. A system for protecting an offshore area from floating objects comprising:

at least one floating buoyant member providing a predetermined upward buoyant force upon submergence;

a mooring line attached to the buoyant member and anchored to the sea bed at a position spaced away from the area to be protected, said mooring line having a length sufficient to allow the buoyant member to float above the surface and allow contact of the floating object with the buoyant member or mooring line, and having a length limited to provide travel constraints on the travel path of the buoyant member such that lateral displacement thereof effects downward travel of the buoyant member, whereby upon collision of a floating object with the buoyant member or mooring line the resulting lateral displacement thereof will effect downward travel and submergence of the buoyant member, and in the downward travel and submergence will absorb kinetic energy of the floating object approaching the offshore area to be protected, and wherein the magnitude of said predetermined upward buoyant force upon submergence is related to the kinetic energy of a predetermined floating object against which protection is desired.

2. The system of claim 1 wherein said buoyant members have a plurality of mooring lines attached thereto.

3. The system of claim 2 including mooring lines anchored to the sea bed and spaced from one another for restricting horizontal travel of the buoyant member.

4. The system of claim 1 comprising a plurality of buoyant members spaced from one another and arranged to at least partially surround the area to be protected.

5. The system of claim 4 comprising interconnecting means for interconnecting adjacent buoyant members.

6. The system of claim 4 wherein the interconnecting means comprises a network for preventing floating objects, smaller than the buoyant member spacing, from passing between adjacent buoyant members.

7. The system of claim 1 arranged for protection against icebergs.

* * * * *